United States Patent [19]

Secolo

[11] Patent Number: 4,782,672

[45] Date of Patent: Nov. 8, 1988

[54] CARPET STEAM DYE MACHINE

[76] Inventor: William J. Secolo, 14631 9th Ave., NE., Seattle, Wash. 98155

[21] Appl. No.: 63,017

[22] Filed: Jun. 17, 1987

[51] Int. Cl.[4] ..... D06B 1/02

[52] U.S. Cl. ..... 68/205 R; 15/321

[58] Field of Search ..... 8/158, 499, 505; 68/205 R, 18 F, 18 C; 15/320, 321, 410

[56] References Cited

U.S. PATENT DOCUMENTS

| | | | |
|---|---|---|---|
| 1,198,373 | 9/1916 | Olson | 8/499 X |
| 3,343,199 | 9/1967 | Nolte | 15/321 X |
| 3,562,844 | 2/1971 | Thompson et al. | 15/321 X |
| 3,594,849 | 7/1971 | Coshow | 15/321 |
| 3,774,261 | 11/1973 | Colt | 15/321 |
| 3,821,830 | 7/1974 | Sundheim | 15/321 |
| 4,164,055 | 8/1979 | Townsend | 15/321 |
| 4,239,490 | 12/1980 | Kelly et al. | 8/499 |
| 4,287,635 | 9/1981 | Jacobs | 15/321 |
| 4,586,208 | 5/1986 | Trevarthen | 15/321 X |

*Primary Examiner*—Philip R. Coe

*Attorney, Agent, or Firm*—Seed and Berry

[57] ABSTRACT

A machine is provided enabling a workman to spray discharge heated dyeing liquid upon a carpet and to immediately thereafter vacuum excess dyeing liquid from the carpet. The dyeing liquid spray discharged onto the carpet is pumped from a receptacle containing dyeing liquid and into which the excess dyeing liquid vacuumed from the carpet is discharged. A pump is provided for pumping liquid from the receptacle to a spray discharge jet nozzle supported from a vacuum nozzle and a heater is also provided for heating the liquid pumped from the receptacle to the spray jet nozzle. Further, filter structure is provided and operative to filter the excess dyeing liquid vacuumed from a carpet and discharged into the dyeing liquid receptacle.

8 Claims, 3 Drawing Sheets

FIG.3
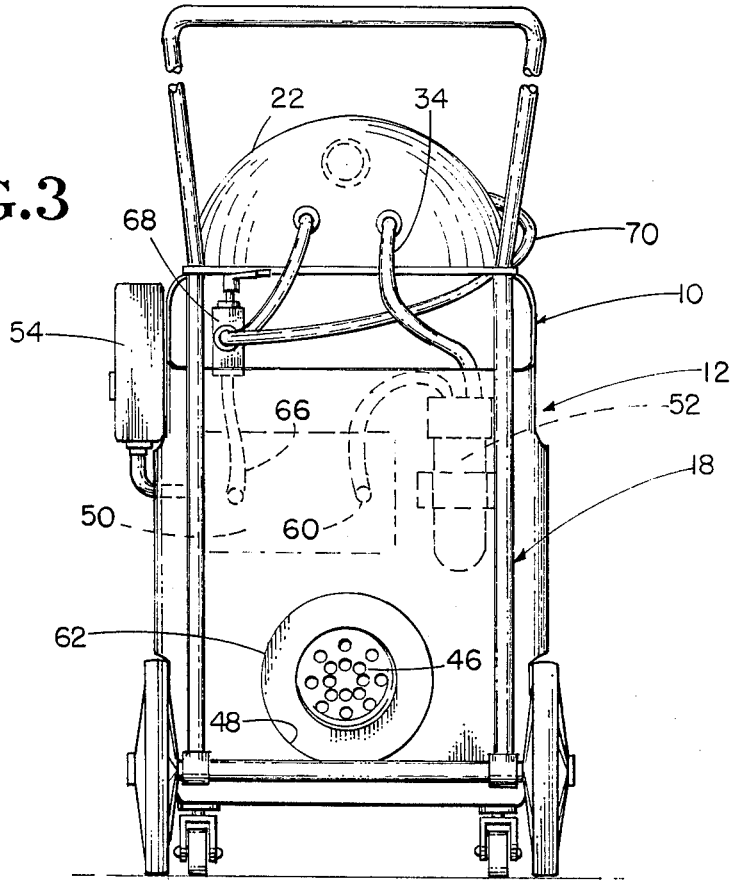
FIG.4
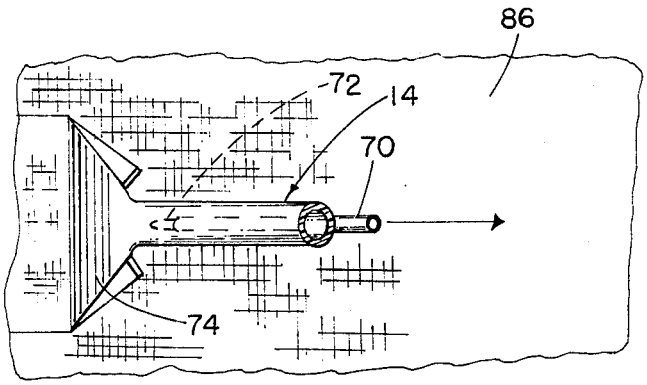
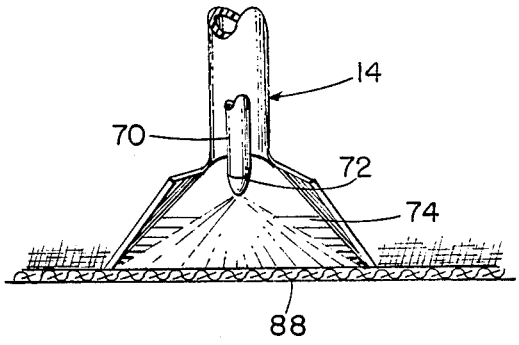
FIG. 5
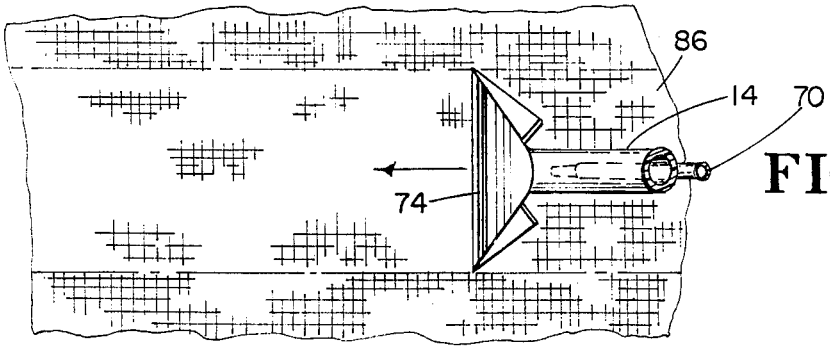
FIG.4A

CARPET STEAM DYE MACHINE

BACKGROUND OF THE INVENTION

1. Field of the Invention

This invention relates to an apparatus operative to spray heated liquid dye onto rugs, carpeting and the like for dyeing the same and further operative to immediately extract excess dye sprayed onto a rug or carpet with the extracted excess dye being passed back to a dye solution tank for storage, filtering, reheating and subsequent high pressure spray application back onto the rug or carpet being dyed.

2. DESCRIPTION OF RELATED ART

Various different forms of spray dyeing machines heretofore have been provided for use in dyeing carpets and rugs. Examples of these previously known forms of spray dyeing machines are disclosed in U.S. Pat. Nos. 1,198,373, 3,562,844 and 4,239,490. However, these previously known forms of spray dyeing machines are not constructed in a manner whereby excess dye sprayed onto a rug or carpet is immediately vacuumed therefrom, reclaimed, filtered and reheated for subsequent spray discharge onto a rug or carpet being dyed.

The liquid dye reclaiming, filtering and reheating features of the instant invention greatly reduce the cost of dye for a given carpet dyeing operation and serve as a further cleaning operation to the carpet being dyed as well as enable a given carpet dyeing operation to be carried out in a shorter period of time.

SUMMARY OF THE INVENTION

The steam dyeing machine of the instant invention incorporates structure for spray discharging, at high pressure, dyeing liquid into a carpet or rug with the dyeing liquid heated to approximately 160° Fahrenheit. Subsequently, the excess dyeing liquid sprayed onto the carpet is immediately vacuumed therefrom, filtered, returned to the supply of dyeing liquid and reheated for spray discharging back upon the carpet or rug.

The carpet dyeing machine is operative to dye carpeting or rugs with a more uniform color result, with the carpet being drier immediately following a dyeing operation, with the carpet or rug being cleaner subsequent to the dyeing operation and with the carpet dyeing operation being carried out in a shorter period of time.

The main object of this invention is to provide a carpet dyeing machine which will be capable of dyeing carpets or rugs with a more uniform color result.

Another object of this invention is to provide a carpet dyeing machine which will effect a more complete dyeing operation and enable an end result color of the carpet or rug being dyed to be more true to the color of dyeing liquid being utilized during the carpet dyeing operation.

Still another important object of this invention is to provide a carpet dyeing machine which will dye a rug or carpet while at the same time performing a further cleaning operation on the carpet or rug being dyed and thereby enable a more complete dyeing operation.

Yet another object of this invention is to provide a carpet dyeing machine which will be capable of performing a given carpet dyeing operation by the utilization of a smaller quantity of dyeing liquid.

Still another object of this invention is to provide a carpet dyeing machine which will enable a given carpet dyeing operation to be carried out in a minimum of time.

A final object of this invention to be specifically enumerated herein is to provide a carpet dyeing machine in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a rear elevational view of the carpet dyeing machine;

FIG. 4 is a fragmentary top plan view illustrating the manner in which the wand portion of the invention is operative to spray heated liquid dye onto a carpet and to immediately vacuum excess liquid dye from the carpet;

FIG. 4A is a top plan view similar to FIG. 4 illustrating the manner in which the wand portion of the invention may be pushed forwardly over an associated carpet with the spray discharge of liquid dye terminated and in a manner to return the nap of the carpet to its original state and to again vacuum overly wetted portions of the carpet; and FIG. 5 is a rear elevational view of the assemblage illustrated in FIG. 4.

DESCRIPTION OF THE PREFERRED EMBODIMENT

Figure 1:
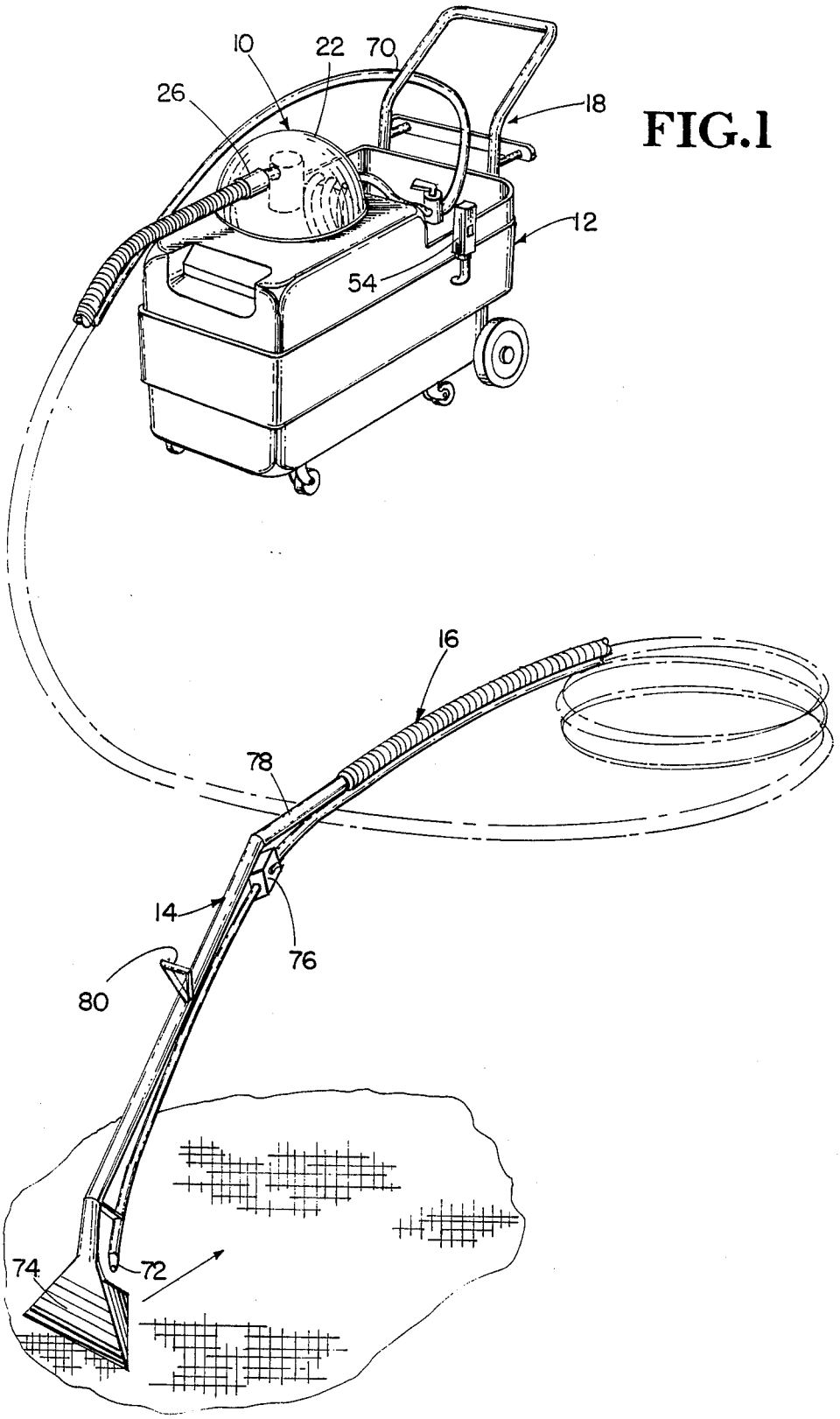
FIG. 1 is a perspective view of the carpet dyeing machine.

Referring now more specifically to the drawings, the numeral 10 generally designates the carpet steam dyeing machine of the instant invention. The machine 10 includes a cannister assembly referred to in general by the reference numeral 12, a wand assembly referred to in general by the reference numeral 14, a flexible hose assembly referred to in general by the reference numeral 16 and operatively connecting the cannister assembly 12 and the wand assembly 14 and a hand truck assembly 18 from which the cannister assembly 12 is supported.

Figure 2:
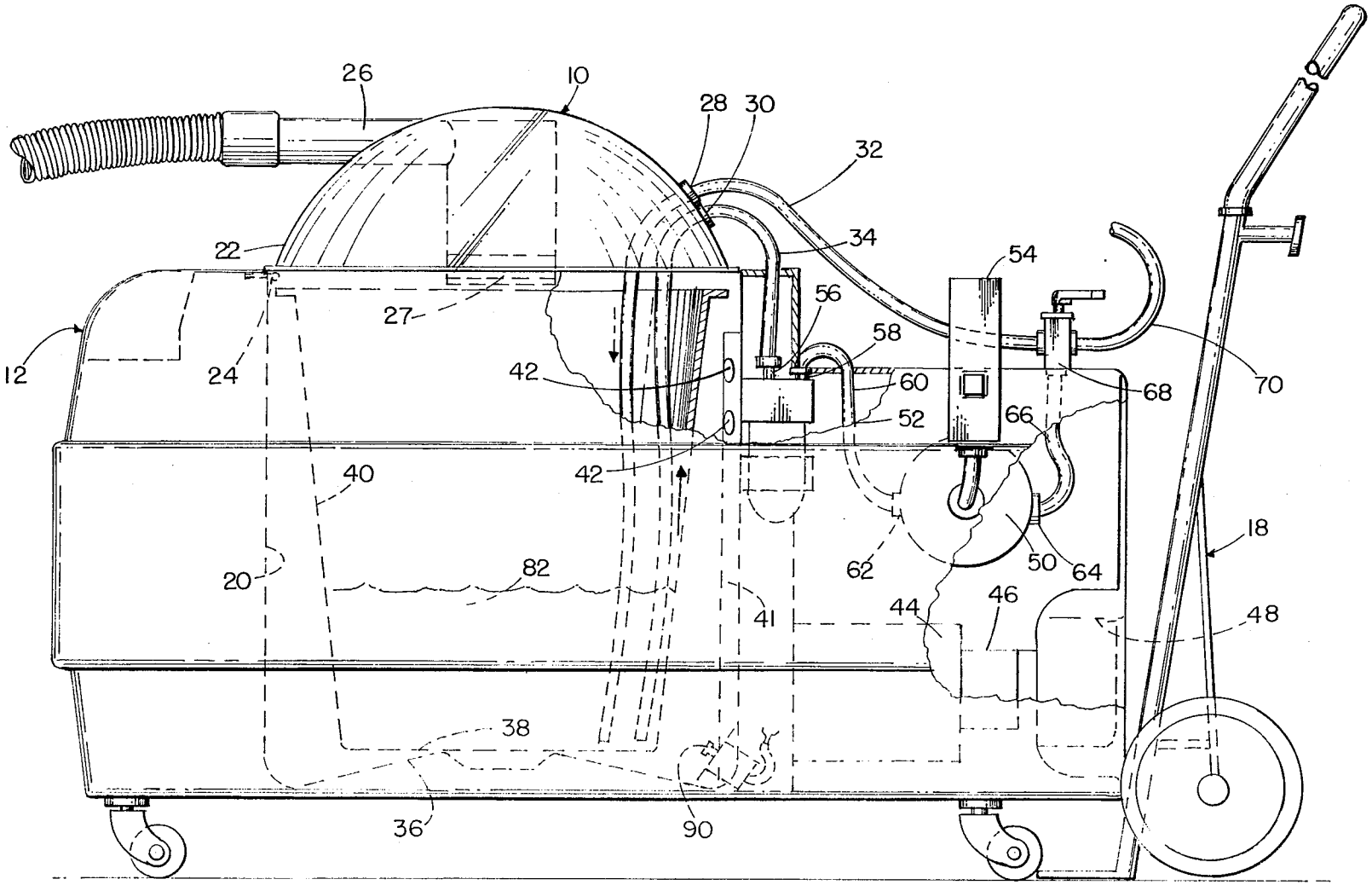
FIG. 2 is an enlarged side elevational view of the cannister portion of the carpet dyeing machine with portions of the interior structure thereof illustrated in phantom lines.

With attention now invited more specifically to FIG. 2, the reference numeral 20 defines an upwardly opening liquid tight well defined within the cannister assembly and the reference numeral 22 designates a transparent dome cover hinged from the assembly 12 as at 24 removably closing the upper end of the well 20. The dome cover 22 includes a vacuum air inlet 26 which opens inwardly through an upper portion of the cover 22 and then extends downwardly to the lower portion of the cover 22 and terminates in a removable filter assembly 27. In addition, the dome cover 22 includes a plurality of openings 28 and 30 therein through which liquid inlet and outlet hoses 32 and 34 extend. The bottom of the well 20 includes a central upward projection 36 upon which the bottom 38 of a removable bucket 40 rests. The upper end of the bucket 40 is open and is loosely received within the well 20.

The rear of the well 20 includes an upstanding vacuum passage 41 therein including upper openings 42 opening into the upper portion of the interior of the well 20 exteriorly of the bucket 40 and a motorized vacuum assembly 44 opens into the interior of the lower portion of the well 20 and includes an outlet 46 registered with a rearwardly opening outlet 48 formed in the cannister assembly 12.

The rear of the cannister assembly 12 is removably anchored to the hand truck assembly 18 in any convenient manner (not shown) whereby the cannister 12 may be readily transported from one location to another. In addition, the interior of the rear of the cannister assembly 12 houses an electric heater 50 and an electric pump 52. The electric heater is under the control of an exteriorly mounted thermostat 54 and the outlet end of the outlet hose 34 is connected to the inlet 56 of the pump 52 while the outlet 58 of the pump 52 has the inlet end of a hose 60 connected thereto. The outlet end of the hose 60 is connected to the inlet 62 of the heater 50 and the outlet 64 of the heater 50 has the inlet end of a hose 66 connected thereto. The outlet end of the hose 66 is connected to a manually operable by-pass valve 68 for alternate discharge through the liquid inlet line 32 or a liquid supply line 70 which extends outwardly along the hose assembly 16 and down to a discharge nozzle 72 mounted immediately rearward of the upper portion of a shield-type vacuum nozzle 74 carried by the inlet end of the vacuum wand assembly 14, the line 70 including an on-off valve 76 serially connected therein. The upper portion of the wand assembly 14 defines a first hand grip 78 adjacent the valve 76 and an intermediate length portion of the wand assembly 14 includes a handle 80. In this manner, the wand assembly 14 may be readily supported by the two hands of an operator and with one hand of the operator closely adjacent the valve 76 for actuation thereof.

In operation, a quantity of liquid dye 82 is disposed within the bucket 40 and the electric pump 52 and heater 50 are actuated with the valve 68 set in a by-pass position. In this manner, the liquid dye within the bucket 40 will be pumped from the bucket 40 through the hose 34 to the pump 52, from the pump 52 through the hose 60 to the heater 50, from the heater 50 to the valve 68 and then from the valve 68 back to the bucket 40 through the hose 32. When the liquid dye has been heated to approximately 160° Fahrenheit the carpet steam dyeing machine 10 is ready for operation and the valve 68 may be actuated to supply heated liquid dye from the heater 50 to the supply line 70. Then, after the vacuum assembly 44 has been actuated, the wand assembly 14 is drawn rearwardly across the carpet to be dyed in the manner illustrated in FIG. 4 with the valve 76 open. The heated liquid dye is spray discharged in a flat spray immediately behind the vacuum nozzle 74 at high pressure (up to 100 PSI) to insure penetration of the liquid dye in the carpet 86 to a depth at least substantially down to the backing 88 of the carpet 86. Thereafter, the excess liquid dye is immediately vacuumed from the carpet 86 by the vacuum nozzle 74 and is discharged through the filter 26 into the bucket 40. Because the heated excess liquid dye is vacuumed from the carpet 86 it is substantially cooled and the heater 50, under the control of the thermostat 54, constantly heats the liquid dye drawn from the bucket 40 by the pump 52 and pumped through the heater 50 so as to insure that the liquid dye will be discharged onto the carpet 86 from the nozzle 72 at substantially 160° Fahrenheit.

The filter assembly 27 is of any suitable removable type and the pump 52 and heater 50 may be of conventional design.

By discharging highly heated liquid dye deep into the carpet 86 substantially all of the nap of the carpet is dyed more evenly. Further, the vacuuming of the excess liquid dye sprayed onto the carpet 86 actually functions to carry out a further carpet cleaning process (the carpet in most cases having been cleaned prior to the dyeing operation) and inasmuch as the excess liquid dye is vacuumed from the carpet 86 and returned to the bucket 40 a carpet dyeing operation may be carried out through the utilization of a smaller quantity of liquid dye.

In the event a particular area of the carpet being dyed is overly wetted, the valve 76 may be momentarily closed by the operator and the wand assembly 14 may be moved in a forward direction as illustrated in FIG. 4A back over the same path of the carpet 86 which was previously vacuumed. This will enable the vacuuming operation to thoroughly vacuum the excess liquid dye from an overly wetted area of the carpet. In addition, forward movement of the wand assembly 14 restores the nap of the rug to the original condition thereof.

If it is desired, the discharge from the 100 PSI pump 52 may pass directly to the supply line 70 and a separate 50 PSI pump (not shown) including a suction line therefor extending down into the bucket 40 may be provided with the discharge of such a 50 PSI pump connected to the inlet 62 of the heater 50 and the outlet 64 of the heater 50 discharging back into the bucket 40, in which instance the valve 68 may be eliminated. Further, the interior of the bottom of the well 20 includes a pair of spaced insulatively supported contacts 90 which, if bridged by an overflow of liquid dye into the well 20, will operate to terminate electrical actuation of the vacuum 44, heater 50 and pump 52.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A carpet dyeing machine including an upwardly opening vacuum chamber, a liquid dye receptacle loosely removably received in said chamber, closure means removably closing said chamber from above, a vacuum hose having an outlet end opening into the upper portion of said chamber and positioned to discharge liquid therefrom into said receptacle and an inlet end equipped with a vacuum nozzle, liquid dye conveying conduit means including an inlet end opening into a lower portion of said receptacle and a spray outlet equipped outlet end supported adjacent said nozzle, said conduit means including pump means and heater means serially connected therein for pumping liquid from said receptacle to said outlet end and heating the pumped liquid.

2. The machine of claim 1 wherein said receptacle defines an upwardly opening container and is upwardly removable through the upper portion of said chamber when the latter is not closed by said closure means.

3. The machine of claim 2 wherein said outlet end of said vacuum hose opens into said chamber through said closure means.

4. The machine of claim 3 wherein said inlet end of said conduit means opens into said chamber through said closure means.

5. The machine of claim 1 including a by-pass line having a first end communicated with said liquid dye conveying conduit means at a point downstream from said pump means and heater means and a second end communicated with said receptacle, and valve means operatively associated with said conduit means and by-pass line operative to selectively open said by-pass line to the portion of said conduit means upstream from said point and terminate communication between the portions of said conduit means upstream and downstream from said point.

6. The machine of claim 5 wherein said heater means includes thermostatic control means for maintaining a predetermined temperature of the liquid dye discharged therefrom.

7. The machine of claim 1 including hand truck means from which said machine is supported.

8. The machine of claim 1 including a housing in which said vacuum chamber is defined and including an upper portion upwardly through which said vacuum chamber opens, said pump and heater also being contained in said housing outwardly of said vacuum chamber.

* * * * *